US008714736B2

(12) United States Patent
Koike et al.

(10) Patent No.: US 8,714,736 B2
(45) Date of Patent: May 6, 2014

(54) PLATEN UNIT AND LIQUID EJECTING APPARATUS

(75) Inventors: Yasunori Koike, Matsumoto (JP); Toshiya Okada, Chino (JP); Takayuki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 24 days.

(21) Appl. No.: 13/544,781

(22) Filed: Jul. 9, 2012

(65) Prior Publication Data

US 2013/0027491 A1 Jan. 31, 2013

(30) Foreign Application Priority Data

Jul. 25, 2011 (JP) ..... 2011-161718

(51) Int. Cl.
*B41J 2/01* (2006.01)

(52) U.S. Cl.
USPC ..... 347/104; 347/105; 347/101; 347/8

(58) Field of Classification Search
USPC ..... 347/104, 105, 101, 8
See application file for complete search history.

(56) References Cited

U.S. PATENT DOCUMENTS 6,543,948 B2 * 4/2003 Beehler et al. ..... 400/635

FOREIGN PATENT DOCUMENTS

| | | |
|---|---|---|
| JP | 2000-289290 | 10/2000 |
| JP | 2009-279780 | 12/2009 |
| JP | 2010-214880 | 9/2010 |

* cited by examiner

*Primary Examiner* — Henok Legesse
(74) *Attorney, Agent, or Firm* — Workman Nydegger

(57) ABSTRACT

A platen unit includes a platen that has a hole for sucking a medium, a platen supporting member that has an internal space which communicates with the hole of the platen, and an elastic member that is provided between the platen and the platen supporting member, and keeps airtightness between the platen and the platen supporting member. In the platen unit, the platen is movable in an up-down direction on the elastic member.

7 Claims, 10 Drawing Sheets

PLATEN UNIT AND LIQUID EJECTING APPARATUS

BACKGROUND

1. Technical Field

The present invention relates to a platen unit and a liquid ejecting apparatus.

2. Related Art

An ink jet printer which forms an image on a medium by ejecting ink is used. In such an ink jet printer, a platen for supporting a medium is provided. The platen supports the medium appropriately so as to keep a distance between a head which ejects ink and the medium properly.

In JP-A-2010-214880 and JP-A-2000-289290, a platen for supporting a sheet at the time of printing has been disclosed. In JP-A-2009-279780, a large format printer which performs printing on a sheet having a large sheet width has been disclosed.

When a medium such as a sheet is transported on a platen, the medium is ensured to be flat appropriately by being sucked by the platen, and so on, in order to keep a distance between a head and the medium to be constant. On the other hand, when the medium enters on the platen, a front end of the medium makes contact with the platen strongly and large static electricity is generated on the platen in some case because the front end of the medium is a free end. If static electricity is generated, an electric field is caused to be generated between the platen and the head. Paper powder flies from the end of the sheet or the like in some case. The paper powder is polarized in the electric field and attracted to the head under the influence of the electric field.

Nozzles for ejecting liquid such as ink are formed on the head. If the paper powder is adsorbed to the nozzles, the nozzles are clogged, resulting in a problem that ink is not ejected appropriately, or the like. Therefore, when the medium enters on the platen, it is desirable for the static electricity to be suppressed from being generated.

SUMMARY

An advantage of some aspects of the invention is to suppress static electricity from being generated on a platen.

At least the following facts will be made clear by the description of the present specification and the accompanying drawings. That is to say, a platen unit includes a platen that has a hole for sucking a medium, a platen supporting member that has an internal space which communicates with the hole of the platen, an elastic member that is provided between the platen and the platen supporting member, and keeps airtightness between the platen and the platen supporting member. In the platen unit, the platen is movable in an up-down direction on the elastic member.

When the medium enters on the platen, a front end thereof hits the platen. This arises a risk that a large frictional force is generated between the medium and the platen. However, with the above-described configuration, the platen is movable in the up-down direction on the elastic member. Therefore, the platen can move downward when the medium enters. This makes it possible to reduce the frictional force between the medium and the platen so as to suppress static electricity from being generated on the platen. In addition, after the medium has entered, a position of the platen can be returned to an original height with an elastic force of the elastic member. Moreover, since the medium is sucked through the hole, the medium can be ensured to be flat on the platen appropriately.

In the platen unit, it is preferable that at least one of the platen and the platen supporting member include a restricting member which restricts an upper limit position of the platen when the platen moves in the up-down direction.

With this configuration, the platen moves downward when the medium enters so as to suppress static electricity from being generated. In addition, when the platen tries to return upward after the medium has entered, the upper limit position of the platen is restricted. Therefore, a distance between a head and the medium on the platen can be kept constant.

Further, it is preferable that the restricting member restrict the upper limit position of the platen in a state where the elastic member is elastically deformed.

With this configuration, when the position of the platen is tried to return upward with an elastic force of the elastic member, the upper limit position of the plate can be restricted. Moreover, the platen can be kept to be at an appropriate height position in such a manner that the elastic force of the elastic member makes the platen press against the upper limit position.

Further, it is preferable that the platen, the platen supporting member, and the elastic member be formed with conductive materials.

With this configuration, even if static electricity is generated on the platen, electric charges thereof can be made to flow out through the elastic member and the platen supporting member.

Further, it is preferable that the platen and the platen supporting member be formed with conductive resins.

With this configuration, the platen which has the suction hole or the like and has a complicated shape, and the platen supporting member can be formed by injection molding and so electric charges can be made to flow out.

Further, it is preferable that the elastic member be provided between the platen and the platen supporting member continuously.

With this configuration, the elastic force of the elastic member can be applied to the platen substantially uniformly.

Further, it is preferable that the restricting member have a projection provided so as not to separate the platen and the platen supporting member that are separated with an elastic force of the elastic member from each other beyond a predetermined distance, and a hook-shaped portion which is engaged with the projection.

With this configuration, the upper limit position of the platen can be restricted appropriately.

In addition, at least the following facts will be also made clear by description of the present specification and the accompanying drawings. That is to say, a liquid ejecting apparatus includes a head which ejects liquid onto a medium, a platen which has a hole for sucking the medium, a platen supporting member that has an internal space which communicates with the hole of the platen, and an elastic member that is provided between the platen and the platen supporting member, and keeps airtightness between the platen and the platen supporting member. In the liquid ejecting apparatus, the platen is movable in an up-down direction on the elastic member.

When the medium enters on the platen, a front end thereof hits the platen. This arises a risk that a large frictional force is generated between the medium and the platen. However, with the above-described configuration, the platen is movable in the up-down direction on the elastic member. Therefore, the platen can move downward when the medium enters. This makes it possible to reduce the frictional force between the medium and the platen so as to suppress static electricity from being generated on the platen. In addition, after the medium has entered, a position of the platen can be returned to an original height with an elastic force of the elastic member. Moreover, since the medium is sucked through the hole, the medium can be ensured to be flat on the platen appropriately.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
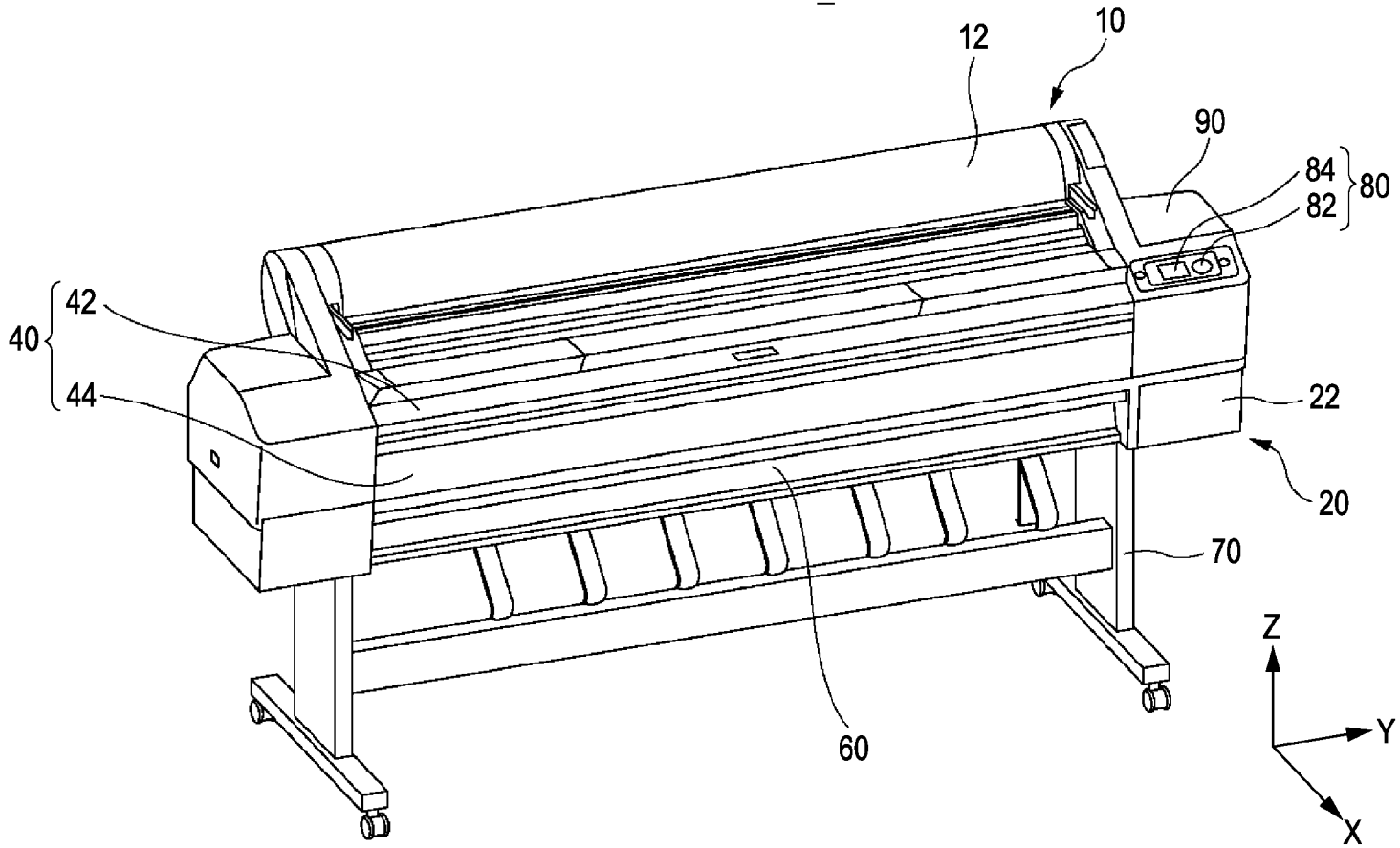
FIG. 1 is a perspective view illustrating an ink jet printer according to an embodiment.

FIG. 1 is a perspective view illustrating an ink jet printer 1 according to an embodiment. As illustrated in FIG. 1, the ink jet printer 1 includes a recording portion 40, a housing 90, a loading portion 10, and leg portions 70. The recording portion 40 is arranged such that a lengthwise direction thereof is horizontal. The housing 90 is attached to an end of the recording portion 40. The loading portion 10 is attached at the upper side of the recording portion 40. The leg portions 70 support the recording portion 40 and the housing 90 from the lower side.

A roll assembly 11 is loaded in the loading portion 10. The roll assembly 11 includes a roll R around which a long recording target medium (see, FIG. 2, hereinafter, also referred to as "medium") is wound in a superimposed manner. In FIG. 1, the roll assembly 11 (see, FIG. 2) is covered by a roll cover 12. An internal mechanism of the recording portion 40 is covered by a top cover 42 and a front cover 44. A head 41 (see, FIG. 2), which will be described later, and the like, are arranged in the recording portion 40. Ink is ejected onto a medium which has been drawn from the roll R in the loading portion 10 and has been fed to the recording portion 40 so that an image is formed.

The medium on which an image has been formed on the recording portion 40 is discharged to the outside from a discharge portion 60 formed at the lower side of the recording portion 40. It is to be noted that the leg portions 70 are attached in order to prevent the medium passing through the discharge portion 60 from making contact with a floor surface.

The housing 90 forms a space for a home position at which the head retreated from the recording portion 40 stands by and has a cartridge holder 20 on a lower portion of the housing 90. An ink cartridge (not illustrated) which houses ink to be supplied to the head is attached to the cartridge holder 20 at the inner side of a holder cover 22 which covers the surface of the cartridge holder 20.

Further, an operation panel 80 is arranged on an upper surface of the housing 90. The operation panel 80 includes a plurality of switches 82 to be operated by a user, and a display portion 84 on which an operation state of the ink jet recording apparatus 1 is displayed. Accordingly, the user operates the ink jet printer 1 from a front surface side while the side at which the operation panel 80 and the cartridge holder 20 are arranged is set to the front surface side.

Figure 2:
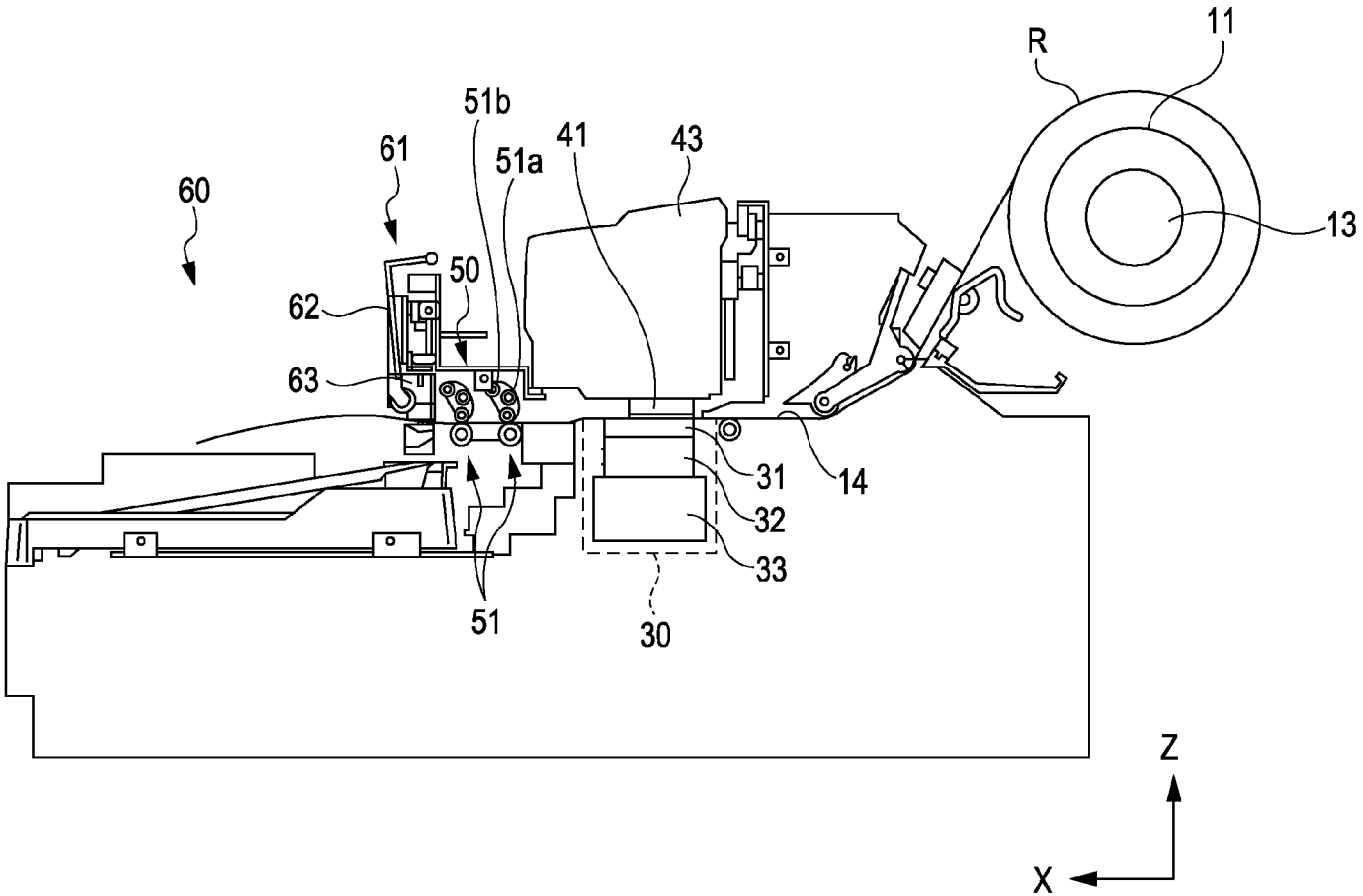
FIG. 2 is a side view illustrating an inner portion of the ink jet printer according to the embodiment.

FIG. 2 is a side view illustrating an inner portion of the ink jet printer 1 according to the embodiment.

As illustrated in FIG. 2, the ink jet printer 1 includes a spindle 13, a transportation path 14, the recording portion 40, the discharge portion 60, and a cutter device 61. The spindle 13 holds the roll R. The roll sheet R is transported on the transportation path 14. The recording portion 40 executes image formation on a medium which is transported. The discharge portion 60 discharges the medium on which image formation has been executed. The cutter device 61 cuts the medium that is discharged from the discharge portion 60. The ink jet printer 1 further includes a platen unit 30 which supports a medium which is transported at a lower side of the head 41, which will be described later. The platen unit 30 includes a platen 31, a platen base 32, and a supporting member 33. Detail configuration of the platen unit 30 will be described later. Further, the ink jet printer 1 includes a controller (not illustrated) which controls operations of the above constituent devices overall.

In the following description, a transportation direction (discharge direction) of the medium is referred to as an X-axis direction, a width direction of the transportation path 14 (direction perpendicular to the paper plane in FIG. 2), which is orthogonal to the X-axis direction, is referred to as a Y-axis direction, and a vertical direction, which is orthogonal to the X-axis direction and the Y-axis direction, is referred to as a Z-axis direction, in some case.

The recording portion 40 includes the head 41 which ejects ink onto a medium which is transported along the transportation path 14. The head 41 is mounted on a carriage 43 which is freely movable in the width direction of the transportation path 14. The head 41 includes a plurality of nozzle rows and is configured so as to eject ink of a predetermined color (for example, yellow (Y), magenta (M), cyan (C), or black (K)) through nozzles on each nozzle row. The head 41 ejects ink onto a recording surface of the roll sheet R supported by the platen 31 so as to execute image formation of recording information of a predetermined image, character, or the like.

The medium on which image formation has been executed on the recording portion 40 passes through a nip portion 50 constituting a termination end of the transportation path 14 and is discharged from the discharge portion 60. The nip portion 50 includes a plurality of discharge rollers 51 which nip the medium and are rotationally driven so as to discharge the medium. The discharge rollers 51 include a mechanism for switching rollers which nip the medium between knurled rollers 51*a* and rotary rollers 51*b* in accordance with a sheet type.

The cutter device 61 which cuts the discharged medium into a predetermined size is provided at the downstream side of the nip portion 50. The cutter device 61 includes a restricting member 62 and a cutter unit 63. The restricting member 62 restricts a height position of the discharged medium. The cutter unit 63 moves in the width direction (Y-axis direction) orthogonal to the discharge direction (X-axis direction) of the medium so as to cut the medium.

Figure 3:
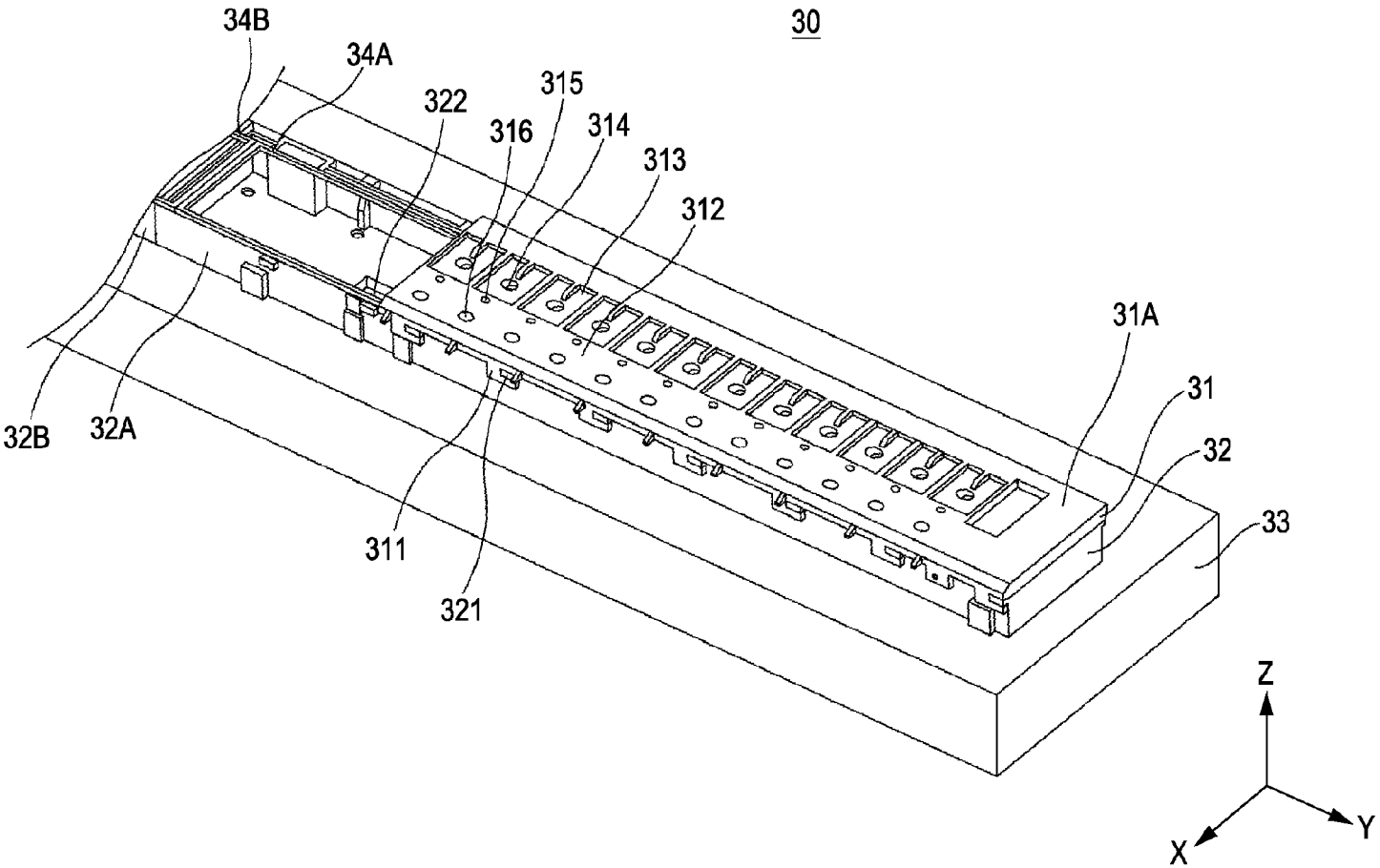
FIG. 3 is a perspective view illustrating a platen unit according to the embodiment.

FIG. 3 is a perspective view illustrating the platen unit 30 according to the embodiment. In FIG. 3, the platen 31, the platen base 32, the supporting member 33, and a sponge 34A (corresponding to an elastic member) are illustrated as a minimum necessary configuration constituting the platen unit 30 according to the embodiment. It is to be noted that FIG. 3 is a perspective view illustrating a part of the platen unit 30 in order to make explanation of a configuration of the platen unit 30 easy.

Figure 4:
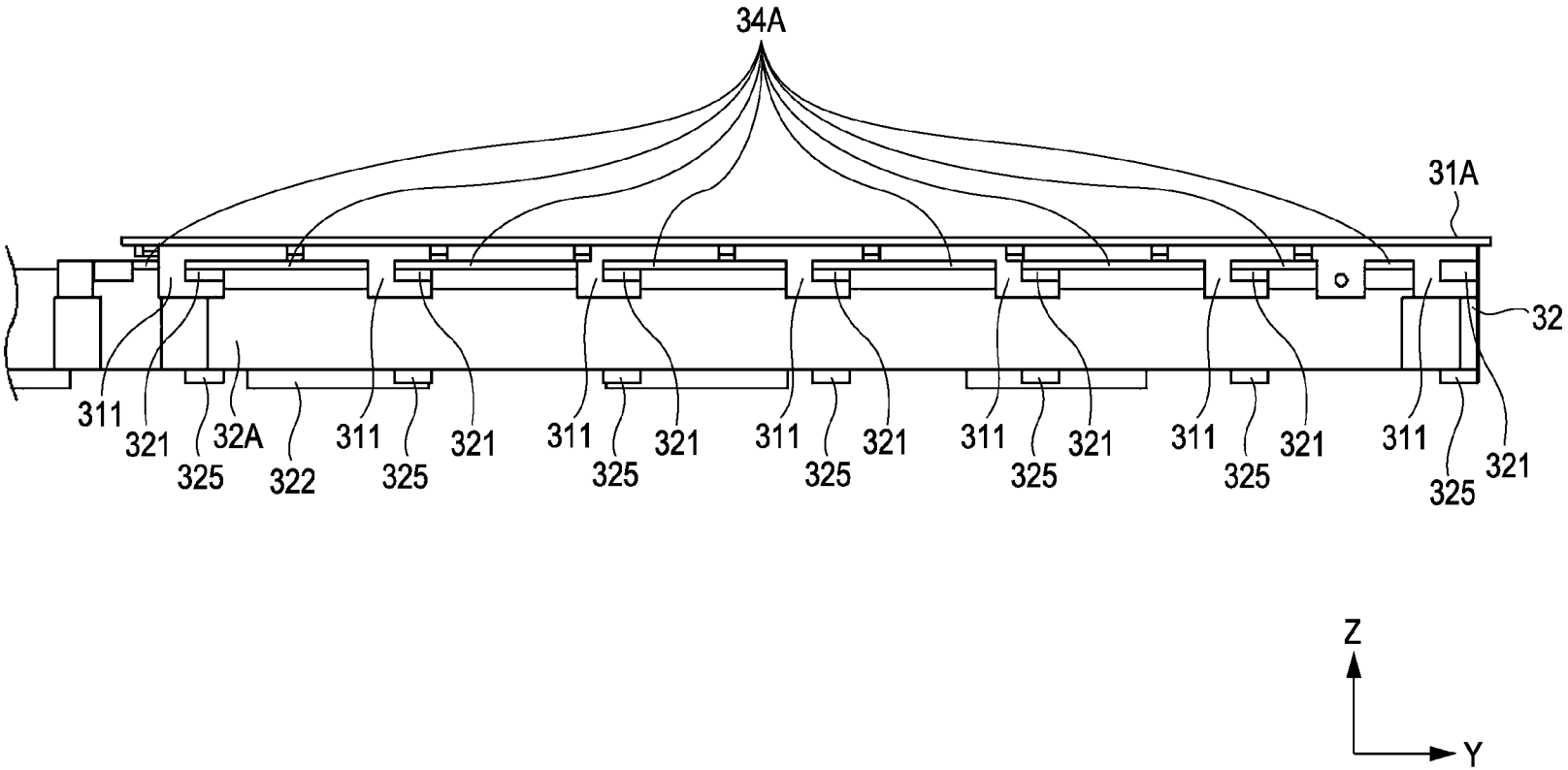
FIG. 4 is a front surface view illustrating a first platen and a first platen base according to the embodiment.

FIG. 4 is a front surface view illustrating a first platen 31A and a first platen base 32A in the embodiment. Each of the platen 31 and the platen base 32 is constituted by a plurality of members. However, in FIG. 4, the first platen 31A and the first platen base 32A (corresponding to a platen supporting member) are illustrated among the plurality of members. FIG. 4 is a view illustrating the first platen 31A and the first platen base 32A when seen from the positive side to the negative side in the X-axis direction in FIG. 2. However, the first platen 31A and the first platen base 32A cannot be visually recognized at this angle in a state of being attached to the ink jet printer 1. In FIG. 4, they are illustrated in a state of being taken out from the ink jet printer 1 for the convenience of explanation.

Hereinafter, outline of the platen unit 30 is described with reference to these drawings. The supporting member 33 is a member for supporting the platen base 32 on an upper portion thereof. The platen base 32 includes the first platen base 32A, a second platen base 32B, and a third platen base 32C (not illustrated in FIG. 3).

Lengths of these platen bases in the sheet width direction (Y-axis direction) are different from one another but they have substantially the same configurations in other points. Therefore, the first platen base 32A is mainly described as an example. Note that the first platen 31A, a second platen 31B (the first platen 31A and the second platen 31B correspond to a platen for the platen supporting member), and a third platen 31C are provided on the upper sides of the first platen base 32A, the second platen base 32B, and the third platen base 32C. Lengths of the first platen 31A, the second platen 31B, and the third platen 31C in the sheet width direction (Y-axis direction) are also different from one another but they have substantially the same configurations in other points. Therefore, the first platen 31A is mainly described as an example.

Both of the platen 31 and the platen base 32 are formed with conductive resins by injection molding. The conductive resins are used for enabling static electricity which is generated on the platen 31 to flow out. Further, an aerial discharge resin is not used because the aerial discharge resin is easy to wear and excellent height accuracy of the platen cannot be ensured for a long period of time.

Further, the platen 31 and the platen base 32 are not manufactured using press-work materials in the following reason. That is, since the shape of the platen 31 is complicated, the number of processes in punching processing of the press-work material is increased. In addition, even if they are manufactured using press-work materials, it is difficult to process them with high accuracy.

A bottom portion of the first platen base 32A includes a plurality of bottom openings 322. As illustrated in FIG. 4, the bottom openings 322 project from a bottom surface of the platen base 32A and have shapes of being fitted into openings of the supporting member 33 (which will be described later). Further, an internal space of the first platen base 32A communicates with an internal space of the supporting member 33. Other platen bases also include bottom openings 322 which communicate with the supporting member 33 in the same manner. Therefore, the internal space of the first platen base 32A, an internal space of the second platen base 32B, and an internal space of the third platen base 32C communicate with one another such that the air therein can move freely thereamong.

The sponge 34A which extends and is continuous is provided on an upper edge periphery of the first platen base 32A. The sponge 34A is desirably a conductive sponge 34A (hereinafter, simply referred to as "sponge 34A" in some case) which is formed with a conductive material in order to make electric charges of the static electricity generated on the first platen 31A flow out to the supporting member 33 through the sponge 34A, as will be described later.

A plurality of projections 321 are provided on the first platen base 32A. The projections 321 project in the transportation direction of the medium (X-axis direction). It is needless to say that the projections 321 are also provided in the opposite direction to the transportation direction of the medium (at the negative side in the X-axis direction).

A plurality of hook-shaped members 311 for hooking on (hereinafter, also referred to as "engaging with") the projections 321 are provided on the first platen 31A. These hook-shaped members 311 are provided so as to cross over the sponge 34A of the first platen base 32A in the X-axis direction when the first platen 31A is attached to the first platen base 32A. That is to say, the hook-shaped members 311 are provided so as to project to the outer side of the first platen base 32A. The hook-shaped members 311 and the projections 321 are provided at the same pitch in the sheet width direction. The plurality of hook-shaped members 311 hook on the corresponding projections 321, respectively. The sponge 34A is inserted between the first platen 31A and the first platen base 32A in a state of being compressed in the up-down direction (Z direction). The first platen 31A receives a force of being separated upward from the first platen base 32A from the sponge 34A. However, the hook-shaped members 311 hook on the projections 321 so that an upper limit of the first platen 31A is restricted.

With this, in a configuration in which at least a part of the first platen 31A is provided on the first platen base 32A, and the second platen 31B is provided on the first platen base 32A and the second platen base 32B, a height at an end of the first platen 31A and a height at an end of the second platen 31B can be made uniform on the first platen base 32A.

In particular, since the ink jet printer 1 having a large size as illustrated in FIG. 1 is long in the sheet width direction, the platen unit is constituted by using the plurality of platen bases and the plurality of platens as described above. However, when the platen unit is constituted by the plurality of platens, if steps are generated among them, there also arises a problem that the medium to be transported floats on the steps. In addition, if such steps are generated, there also arises a risk that air leakage occurs on the steps and the medium is not sucked on the platens appropriately. This causes an obstacle for transportation of the roll sheet which is frequently used in the ink jet printer 1 having a large size, in particular. However, with the above-described configuration according to the embodiment, the height at the end of the first platen 31A and the height at the end of the second platen 31B can be made uniform, thereby preventing steps from being generated therebetween.

A supporting surface 312 and grooves 313 are provided on the first platen 31A. The supporting surface 312 supports the medium to be transported. The grooves 313 prevent liquid such as ink which has been wastefully ejected from making contact with the medium which is being transported. First suction holes 314 through which ink and the medium are sucked are provided on the grooves. The first suction holes 314 penetrate through the first platen 31A from the upper side to the lower side (in the Z-axis direction). Further, on the first platen 31A, a plurality of second suction holes 315 and third suction holes 316 are provided on the supporting surface 312 which supports the medium to be transported.

A plurality of contact portions 325 which abut against the supporting member 33 are provided on a bottom portion of the first platen base 32A. Holes are opened at the centers of some contact portions 325 among the plurality of contact portions 325. The first platen base 32A is secured to the supporting member with fastening members such as screws through the opened holes. Further, these contact portions 325 are provided at positions of overlapping with portions on which abutment surfaces (which will be described later) of the projections 321 and abutment surfaces of the hook-shaped members 311 make contact with each other in the sheet width direction (Y-axis direction). With this, distances between the contact portion 325 and the abutment surfaces can be made closer to each other. This makes it possible to ensure a height from the platen to the supporting member with higher accuracy.

Figure 5:
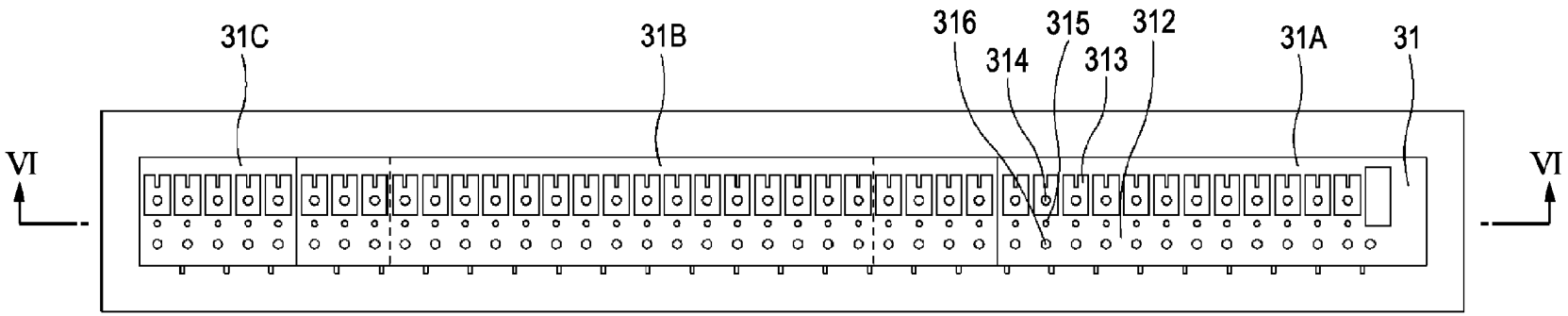
FIG. 5 is a top view illustrating the platen unit according to the embodiment.
Figure 6:
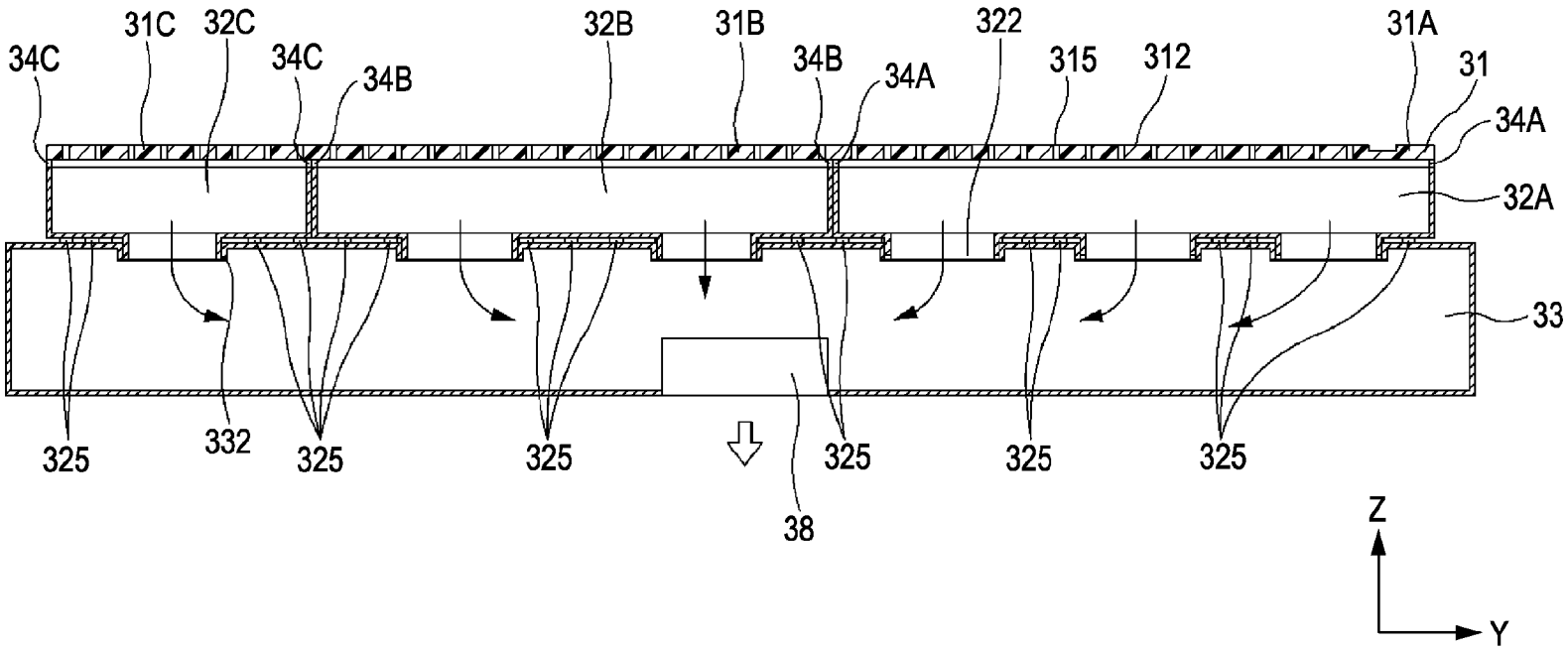
FIG. 6 is a cross-sectional view illustrating the platen unit.

FIG. 5 is a top view illustrating the platen unit 30 according to the embodiment. FIG. 6 is a cross-sectional view illustrating the platen unit 30 cut along a line VI-VI. FIG. 5 illustrates the platen 31 which is constituted by the first platen 31A, the second platen 31B, and the third platen 31C. Further, lengths of these platens in the sheet width direction are different from one another as illustrated in FIG. 5. Note that the number of platens which constitute the platen unit is not limited thereto. In addition, the lengths of the platens in the sheet width direction are not limited thereto.

In FIG. 6, the first platen base 32A, the second platen base 32B, and the third platen base 32C are provided on the supporting member 33. Further, the first platen 31A, the second platen 31B, and the third platen 31C are provided thereon.

The first platen base 32A, the second platen base 32B, and the third platen base 32C are fitted into openings 332 of the supporting member 33 through the bottom openings 322. Lengths of the first platen base 32A, the second platen base 32B, and the third platen base 32C in the sheet width direction (Y-axis direction) are different from one another.

A sucking device 38 is provided at a center bottom portion of the supporting member 33. The sucking device 38 discharges the air in an internal space constituted by the platen 31, the platen base 32, and the supporting member 33 to the outside of the platen unit 30. In this manner, the air pressure in the internal space is kept to be lower than outside atmospheric pressure. This causes the medium which is transported on the platen 31 to be adsorbed to the platen through the above-described first suction holes 314, the second suction holes 315, and the third suction holes 316. With this, the medium is adsorbed to the platen as a flat surface so that a surface of the medium is also ensured to be flat. Accordingly, ink droplets can be ejected onto the medium which is kept to be flat. Therefore, a distance between the head and the medium can be kept uniform in the sheet width direction and the transportation direction. This makes it possible to make ink droplets land at desired positions so as to provide a printed material with preferable image quality.

As described above, the sponge 34A which extends and is continuous is provided on the upper edge periphery of the first platen base 32A. In the same manner, a sponge 34B which extends and is continuous is provided on an upper edge periphery of the second platen base 32B. Further, a sponge 34C which extends and is continuous is provided on an upper edge periphery of the third platen base 32C. These sponges are compressed in the up-down direction (Z-axis direction) when the hook-shaped members 311 are engaged with the projections 321 and the platens are secured. That is to say, the sponges are elastically deformed so as to make contact with the platen bases and the platens tightly. Therefore, airtightness between the platen bases and the platens can be enhanced.

Figure 7A:
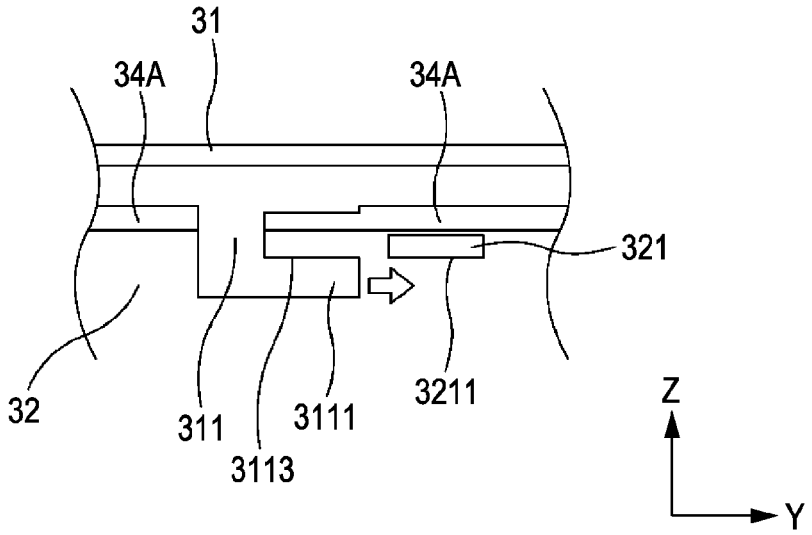
FIG. 7A is a first enlarged view illustrating a hook-shaped member of a platen and a projection according to the embodiment.
Figure 7B:
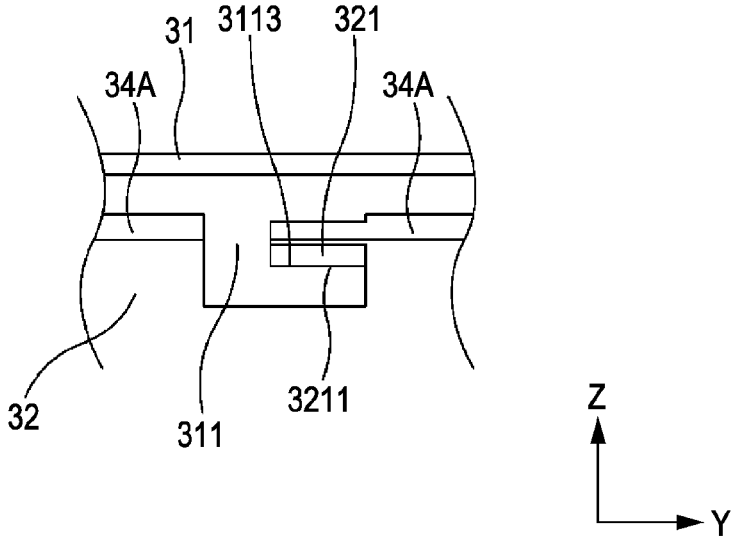
FIG. 7B is a second enlarged view illustrating the hook-shaped member of the platen and the projection according to the embodiment.

FIG. 7A is a first enlarged view illustrating the hook-shaped member 311 of the platen 31 and the projection 321 according to the embodiment, and FIG. 7B is a second enlarged view illustrating the hook-shaped member 311 of the platen 31 and the projection 321 according to the embodiment. Here, engagement between each hook-shaped member 311 and each projection 321 is described with reference to FIG. 7A and FIG. 7B.

FIG. 7A and FIG. 7B illustrate the projection 321, and an abutment surface 3211 of the projection 321. FIG. 7A and FIG. 7B illustrate an abutment surface 3113 of the hook-shaped member 311, which makes contact with the abutment surface 3211 of the projection 321. A normal line of the abutment surface 3211 of the projection 321 coincides with a normal line of the supporting surface 312. Further, a normal line of the abutment surface 3113 of the hook-shaped member 311 also coincides with the normal line of the supporting surface 312.

Each platen is made to slide in the sheet width direction (to the positive side in the Y-axis direction) on the platen base 32 so that the hook-shaped member 311 of the platen 31 is engaged with the projection 321 of the platen base 32. When the hook-shaped member 311 hooks on the projection 321, the sponge 34A is made into a state of being compressed in the up-down direction as described above. The abutment surface 3211 of the projection 321 is pressed against the abutment surface 3113 of the hook-shaped member 311 reliably with a pressurizing force by the elastic deformation of the sponge 34A.

The abutment surface 3211 of the projection 321 makes contact with the abutment surface 3113 of the hook-shaped member 311 reliably in this manner. With this, a height from the contact portion 325 of the platen base 32 to the supporting surface 312 of the platen 31 is ensured to be a height calculated in design. Especially, the normal line of the abutment surface 3211 of the projection 321 and the normal line of the abutment surface 3113 of the hook-shaped member 311 coincide with the normal line of the supporting surface 312. Therefore, these abutment surfaces 3113, 3211 are made contact with each other reliably with the above-described configuration so that the supporting surface 312 on which the medium passes through can be ensured to be flat.

Further, the plurality of hook-shaped members 311 and projections 321 are provided in the sheet width direction. Therefore, the height from the contact portions 325 of the platen base 32 to the supporting surface 312 of the platen 31 can be made uniform over the entire region in the sheet width direction.

Figure 8A:
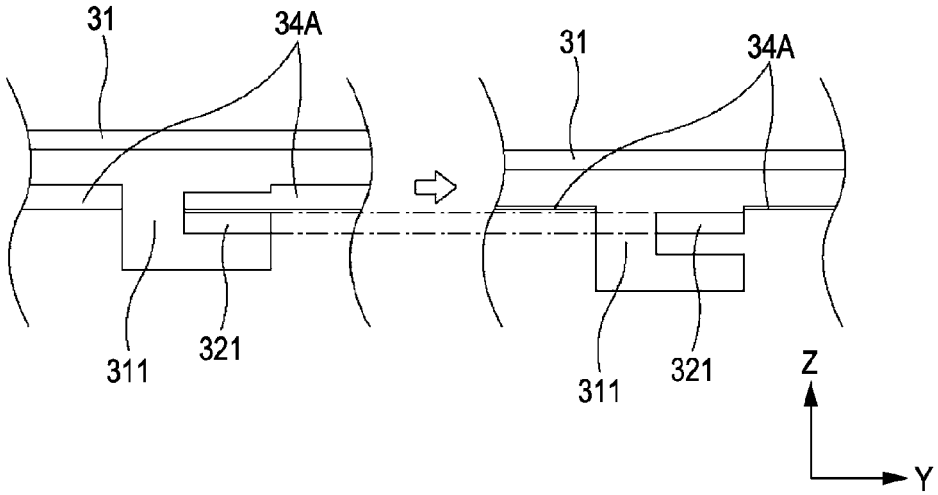
FIG. 8A is a view around the hook-shaped member when the platen is moved in the up-down direction.
Figure 8B:
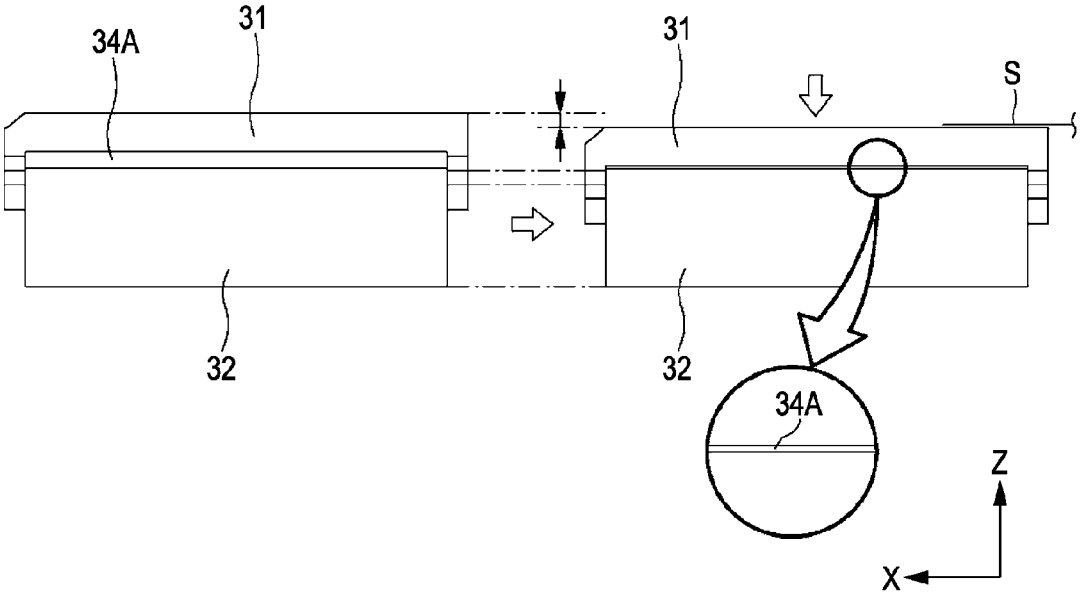
FIG. 8B is an inner side view illustrating the platen and a platen base when the platen is moved in the up-down direction.

FIG. 8A is a view around the hook-shaped member 311 when the platen 31 moves in the up-down direction. In FIG. 8A, the platen 31, the sponge 34A, the hook-shaped member 311, and the projection 321 are illustrated. FIG. 8B is an inner side view illustrating the platen 31 and the platen base 32 before and after the platen 31 moves in the up-down direction.

A position of the platen 31 in a state before the medium is transported is illustrated at left sides in FIG. 8A and FIG. 8B. In FIG. 8A, the hook-shaped member 311 is hooked on the projection 321 in a state where the sponge 34A is compressed in the up-down direction. That is to say, a force of being separated upward (to the positive side in the Z-axis direction) from the platen base 32 is applied to the platen 31. However, the upper limit position of the platen 31 is restricted by the hook-shaped member 311 and the projection 321.

On the other hand, a state where the front end of the medium enters an upper portion of the platen and a position of the platen 31 descends is illustrated at right sides in FIG. 8A and FIG. 8B. In FIG. 8A and FIG. 8B, each member is illustrated based on a position of the projection 321 such that a movement state of the platen 31 is recognized.

If the front end of the medium enters on the platen 31 while hitting the platen 31, a downward force (to the negative side in the Z-axis direction) acts on the platen 31. Therefore, the sponge 34A as an elastic member is further compressed and the platen 31 moves downward. If the platen 31 cannot move downward, a contact force between the platen 31 and the medium becomes larger and static electricity is generated with a large frictional force therebetween. On the other hand, with the configuration as in the embodiment, the sponge 34A enables a force when the medium enters to escape with the downward movement of the platen 31. Therefore, static electricity with the frictional force can be suppressed from being generated.

Figure 9:
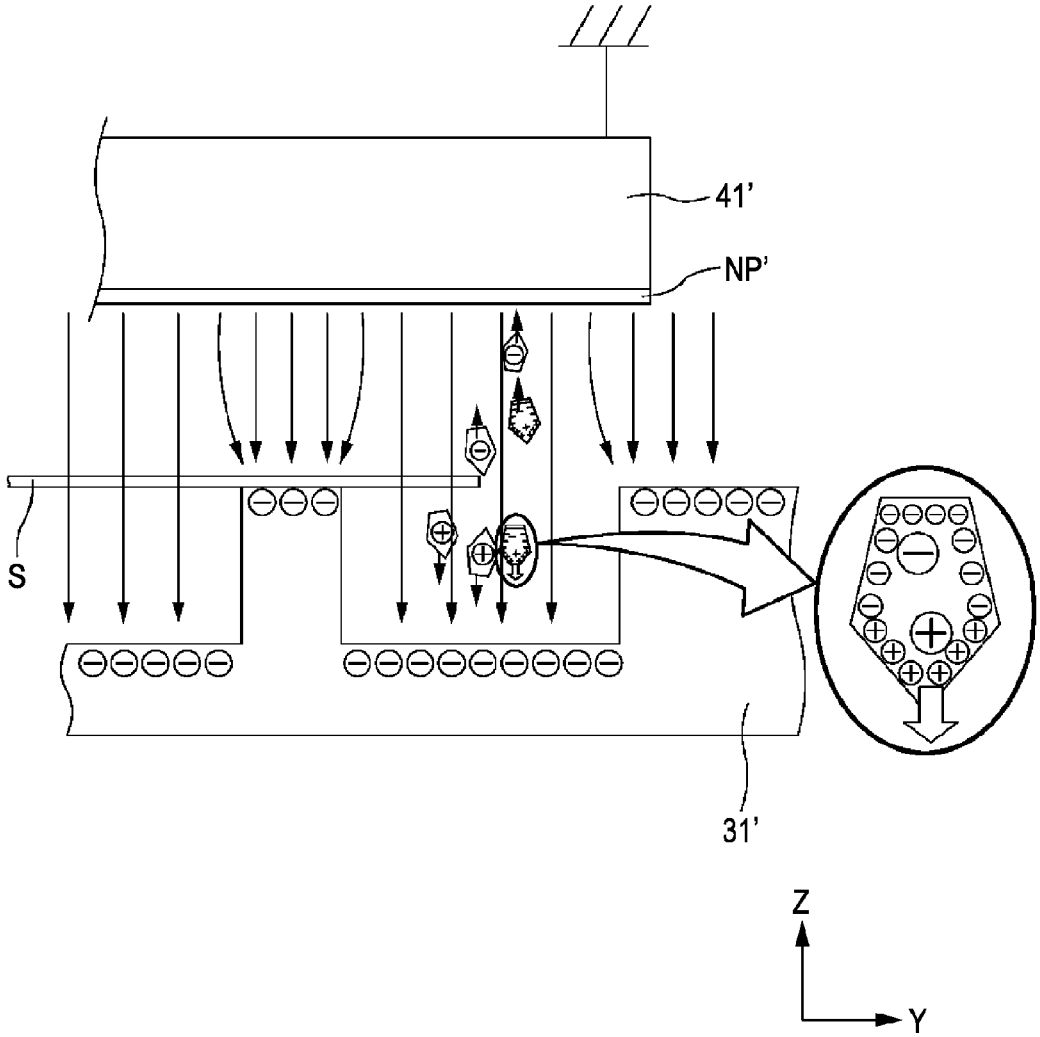
FIG. 9 is a descriptive view for explaining an electric field when a platen is insulated.

FIG. 9 is a descriptive view for explaining an electric field when a platen 31' is insulated. In FIG. 9, the platen 31' and a nozzle plate NP' of a head 41' are illustrated. Further, a sheet S is illustrated as a medium to be transported on the platen.

With the configuration in the embodiment, static electricity is unlikely to be generated when the front end of the medium enters. However, if the sheet S passes through on the platen 31', static electricity is generated with a frictional force that is generated between the platen 31' and the sheet S in some case.

In particular, in the ink jet printer 1 having a large size as in the embodiment, the sheet S having a large width in the sheet width direction is transported mainly. Further, the sheet S is sucked through the above-described first suction holes 314 to third suction holes 316 in order to prevent the sheet S from floating from the platen 31'. Therefore, the frictional force between the sheet S and the platen 31' is large and static electricity is generated on the platen 31' in some case.

In FIG. 9, the head 41' has the same potential as that of a main unit side through cables, and is grounded. Therefore, a potential of the nozzle plate NP' is zero. In this case, if removal of electricity is not performed when the platen 31' has been charged, a potential difference is generated between the platen 31' and the nozzle plate NP' of the head 41', resulting in a risk that an electric field is generated.

When the sheet S passes through, paper powder flies from the end of the sheet S mainly. If the paper powder flies in the electric field, individual paper power is dielectrically polarized as illustrated in FIG. 9. The paper powder which has been dielectrically polarized is adsorbed to the platen 31' or the nozzle plate NP'.

Nozzles (not illustrated) are provided in the nozzle plate NP' and ink is ejected through these nozzles. However, if the paper powder is adsorbed to the nozzle plate NP', the adsorbed paper powder causes clogging of the nozzles. Then, nozzles through which ink cannot be ejected are generated, and desired dots are not formed on pixels on which dots are to be formed through the corresponding nozzles (so-called missing dots occur).

Cleaning of the nozzles is performed in order to prevent such missing dots from occurring. However, since the cleaning is performed by forcibly ejecting ink through the nozzles, ink is consumed wastefully. Further, there also arises a disadvantage that a discharge amount of waste liquid is increased due to the forcible ejection of ink. Therefore, it is desired that paper powder is not adhered to the nozzle plate NP'.

Accordingly, in the embodiment, in addition to the configuration in which the platen 31 moves downward in the above-described manner so as to prevent static electricity from being easily generated when the medium enters, electric charges of the platen 31 are made to flow out with the following configuration.

Figure 10:
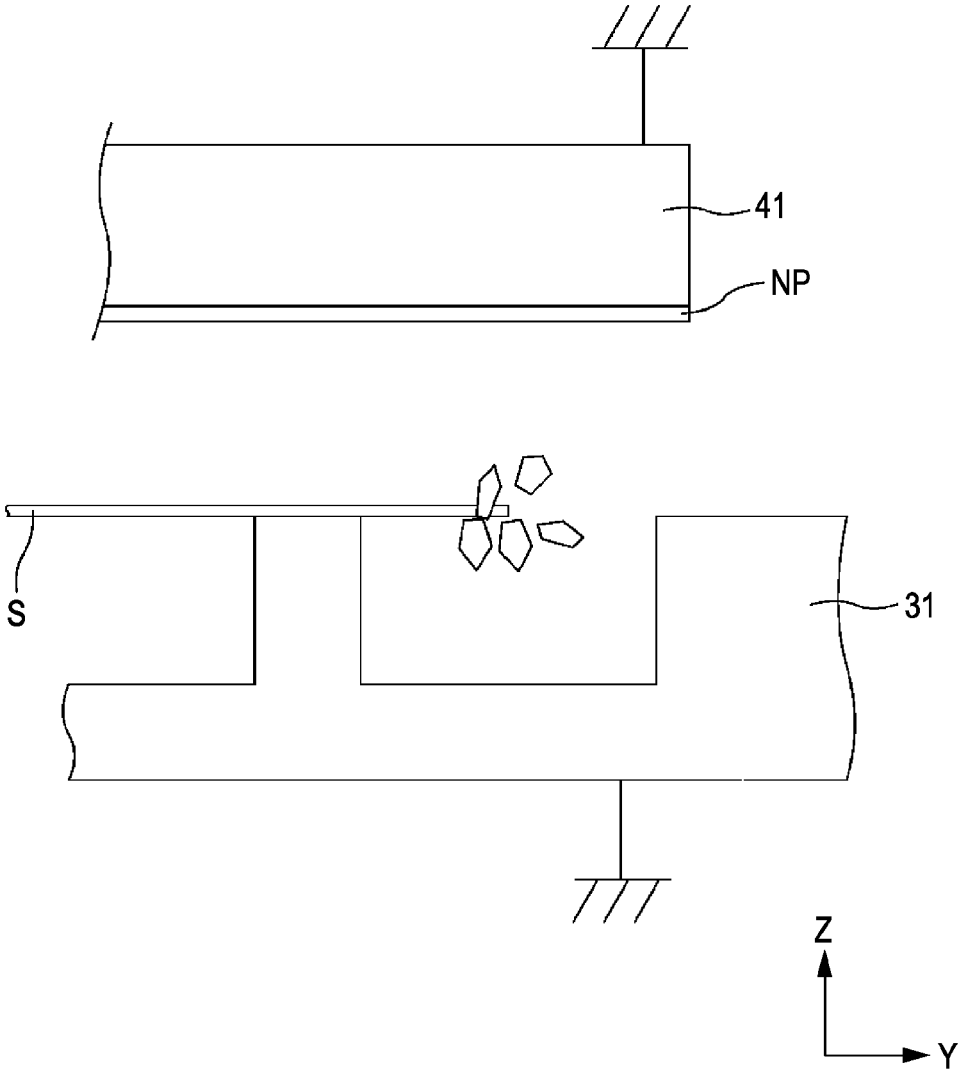
FIG. 10 is a descriptive view for explaining an electric field when the platen is grounded.

FIG. 10 is a descriptive view for explaining an electric field when the platen 31 is grounded. In consideration of the above-described adherence process of paper powder, it is desirable that the platen 31 is suppressed from being charged. Therefore, the platen 31 in the embodiment is grounded through the sponge 34A, the platen base 32, and the supporting member 33 with the above-described configuration. Note that the supporting member 33 is set to have the same potential as that of the ink jet printer 1.

As described above, the platen 31 and the platen base 32 are formed with conductive resins. Further, the platen 31 and the platen base 32 are electrically connected to each other through the sponge 34A. In addition, the platen base 32 securely makes contact with the supporting member 33 formed with the press-work through the contact portions 325 of the plate base 32.

With this configuration, the electric charges of the platen 31 can be made to flow out through the platen base 32 and the supporting member 33. This prevents an electric field from being generated between the nozzle plate NP of the head 41 and the platen 31. Therefore, paper powder is difficult to be adsorbed to the nozzle plate NP. This makes it possible to provide the ink jet printer 1 in which missing dots are not easy to occur.

Other Embodiments

In the above-described embodiment, the sponge 34A formed with a conductive material is employed as an elastic member. However, a conductive sponge may be formed by making a general sponge absorb glycerin or the like. Further, the elastic member is not limited to the sponge and another material can be applied to the elastic member.

In the above-described embodiment, the printer 1 has been described as a liquid ejecting apparatus. However, the liquid ejecting apparatus is not limited thereto and can be embodied in liquid discharge apparatuses which eject and discharge liquids other than ink (liquid, liquid state material in which particles of a functional material are dispersed, fluid state material such as gel). For example, a technique which is the same as the above-described embodiment may be applied to various apparatuses in which an ink jet technique is applied. The apparatuses in which the ink jet technique is applied include a color filter manufacturing apparatus, a dyeing apparatus, a microfabricating apparatus, a semiconductor manufacturing apparatus, a surface processing apparatus, a three-dimensional molding machine, a gas vaporizing apparatus, an organic EL manufacturing apparatus (in particular, macromolecular EL manufacturing apparatus), a display manufacturing apparatus, a film forming apparatus, and a DNA chip manufacturing apparatus, for example. Further, methods and manufacturing methods therefor are encompassed within the application range.

The above-described embodiment is intended to make the invention be understood easily and is not intended to limit the interpretation of the invention. The invention can be changed and improved without departing from the scope of the invention and equivalents thereof are encompassed in the invention.

Head

The method of ejecting ink is not limited to the method of ejecting ink using piezoelectric elements. For example, other methods such as a method of generating bubbles in nozzles with heat may be employed.

The entire disclosure of Japanese Patent Application No. 2011-161718, filed on Jul. 25, 2011 is expressly incorporated by reference herein.

What is claimed is:

1. A platen unit, comprising:

a platen that has a hole for sucking a medium;

a platen supporting member that has an internal space which communicates with the hole of the platen; and an elastic member that is provided between the platen and the platen supporting member, and keeps airtightness between the platen and the platen supporting member, wherein the platen is movable in a down direction when the elastic member is compressed and moveable in an up direction when the elastic member is no longer compressed after being compressed, wherein at least one of the platen and the platen supporting member includes a restricting member which restricts an upper limit position of the platen when the platen moves in the up direction.

2. The platen unit according to claim 1, wherein the restricting member restricts the upper limit position of the platen in a state where the elastic member is elastically deformed.

3. The platen unit according to claim 1, wherein the platen, the platen supporting member, and the elastic member are formed with conductive materials.

4. The platen unit according to claim 3, wherein the platen and the platen supporting member are formed with conductive resins.

5. The platen unit according to claim 1, wherein the elastic member is provided between the platen and the platen supporting member continuously.

6. The platen unit according to claim 1, wherein the restricting member has a projection provided so as not to separate the platen and the platen supporting member that are separated with an elastic force of the elastic member from each other beyond a predetermined distance, and a hook-shaped portion which is engaged with the projection.

7. A liquid ejecting apparatus comprising:

a head which ejects liquid onto a medium;

a platen which has a hole for sucking the medium;

a platen supporting member that has an internal space which communicates with the hole of the platen; and an elastic member that is provided between the platen and the platen supporting member, and keeps airtightness between the platen and the platen supporting member, wherein the platen is movable in a down direction when the elastic member is compressed and moveable in direction when the elastic member is no longer compressed after being compressed, wherein at least one of the platen and the platen supporting member includes a restricting member which restricts an upper limit position of the platen when the platen moves in the up direction.

* * * * *